US011270572B2

(12) United States Patent
Naserialiabadi et al.

(10) Patent No.: US 11,270,572 B2
(45) Date of Patent: Mar. 8, 2022

(54) SYSTEM AND METHOD FOR ALERTING A USER TO THE PRESENCE OF ENVIRONMENTAL SOUNDS

(71) Applicant: Veebar Tech, Toronto (CA)

(72) Inventors: Ayda Naserialiabadi, Toronto (CA); Younes Sadat-Nejad, Toronto (CA)

(73) Assignee: Veebar Tech, Toronto (CA)

( * ) Notice: Subject to any disclaimer, the term of this patent is extended or adjusted under 35 U.S.C. 154(b) by 0 days.

(21) Appl. No.: 17/018,848

(22) Filed: Sep. 11, 2020

(65) Prior Publication Data

US 2021/0082273 A1 Mar. 18, 2021

Related U.S. Application Data

(60) Provisional application No. 62/899,853, filed on Sep. 13, 2019.

(51) Int. Cl.

| | |
|---|---|
| ***G08B 23/00*** | (2006.01) |
| ***H04R 1/08*** | (2006.01) |
| ***G08B 3/10*** | (2006.01) |

(52) U.S. Cl.

CPC ..... *G08B 23/00* (2013.01); *G08B 3/10* (2013.01); *H04R 1/08* (2013.01)

(58) Field of Classification Search

CPC ..... G08B 23/00

See application file for complete search history.

(56) References Cited

U.S. PATENT DOCUMENTS

| | | | | |
|---|---|---|---|---|
| 8,917,186 | B1 * | 12/2014 | Grant | G08B 1/08 340/692 |
| 9,059,669 | B2 * | 6/2015 | Shah | H03G 3/3005 |
| 9,576,464 | B2 * | 2/2017 | Powley | H04N 21/478 |
| 10,163,313 | B2 * | 12/2018 | Subramanian | G08B 25/001 |
| 10,567,904 | B2 * | 2/2020 | Sahay | H04R 1/1041 |
| 10,600,291 | B2 * | 3/2020 | Kashar | G06F 1/163 |
| 2016/0117905 | A1 * | 4/2016 | Powley | H04R 1/08 340/521 |

* cited by examiner

*Primary Examiner* — Travis R Hunnings

(57) ABSTRACT

An alert system with at least one microphone, an output device, and a processor in communication with the at least one microphone via a microphone communication link and with the output device via an output device communication link. The processor is configured to receive over the microphone communication link captured sound data based on a sound captured by the at least one microphone, determine whether the captured sound data corresponds to a first alert sound of a plurality of alert sound data, and in response to determining that the captured sound data corresponds to the first alert sound, determine an output alert profile for the first alert sound. The processor sends, to the output device, instructions to perform the output alert profile and the output device may be configured to perform the output alert profile upon receiving the instructions.

20 Claims, 5 Drawing Sheets

SYSTEM AND METHOD FOR ALERTING A USER TO THE PRESENCE OF ENVIRONMENTAL SOUNDS

RELATED APPLICATIONS

This application claims priority to U.S. Provisional Patent Application No. 62/899,853, filed Sep. 13, 2019.

TECHNICAL FIELD

The present disclosure relates generally to an alert system, and more particularly to an alert system comprising a microphone for alerting a user to the presence of environmental sound.

BACKGROUND

Individuals interact with a variety of machines which alert the user to events occurring through the use of an auditory medium. Individuals who are unable to interact with the medium often miss the alerts from the respective machines. Individuals may be incapable of interacting with auditory subject matter, may have reduced auditory capacity, or may suffer from distorted auditory capacity. Failing to appreciate an alert from a machine can have health altering consequences, where machines are responsible for life saving alerts, or failing to appreciate an alert can have economic consequences, where a machine alert represents an impending harm to a person or machine, requiring repairs or corrective action.

An improved alert system is required where an auditory medium is not able to effectively convey alerts.

SUMMARY OF THE INVENTION

The present disclosure provides a first aspect having an alert system with at least one microphone, an output device, and a processor in communication with the at least one microphone via a microphone communication link and with the output device via an output device communication link. The processor may be configured to receive over the microphone communication link captured sound data based on a sound captured by the at least one microphone, determine whether the captured sound data corresponds to a first alert sound of a plurality of alert sound data, and in response to determining that the captured sound data corresponds to the first alert sound, determine an output alert profile for the first alert sound. The processor may further send, to the output device, instructions to perform the output alert profile and the output device may be configured to perform the output alert profile upon receiving the instructions.

In example embodiments, the output device comprises a light emitter and the output alert profile comprises a flickering sequence.

In example embodiments, the at least one microphone further comprises attachment means for attaching the at least one microphone to a surface or object close to a captured sound source.

In example embodiments, the at least one microphone further comprises a microphone processor configured to determine whether the captured sound data exhibits a first characteristic of the first alert sound, and in response to determining that the captured sound data exhibits the first characteristic, send the captured sound to the processor. The processor may also be configured to enter into a sleep mode and in response to the step of receiving captured sound data over the microphone communication link, exit the sleep mode.

The first characteristic may comprise an audio signal amplitude over a first threshold or an audio signal frequency within a first frequency range.

In example embodiments, the processor is located on a remote server or cloud based computing system, and the microphone communication link and output communication link each comprise a network communication link.

In example embodiments, the processor is further configured to receive trained sound data and a customized alert profile related to the trained sound data and store the trained sound data as corresponding to one of the plurality of alert sound data. In response to receiving the captured sound data from the at least one microphone, the processor may further determine whether the sound is the trained sound and, in response to determining that the captured sound data is the trained sound data, determine that the captured sound data corresponds to one of the plurality of alert sound data and send, to the output device, instructions to perform the output alert profile.

In example embodiments, the processor may be configured to enter into a training mode, receive a training sound data from the at least one microphone, store the training sound data as corresponding to one of the plurality of alert sound data, and exit the training mode. The processor may, in response to receiving the captured sound data from the at least one microphone, determine whether the captured sound data corresponds to the training sound data and in response to determining that the captured sound data corresponds to the training sound data, determine that the captured sound corresponds to one of the plurality of alert sound data. The processor may further display, on a user device, receipt of the training sound data and receive, via the user device, a training sound label and training sound alert profile. The processor can then store the training sound data, the training sound label and the related training sound alert profile, and in response to determining that the captured sound data corresponds to the training sound data, send to the output device instructions to perform the training sound alert profile.

In example embodiments, the at least one microphones include a visual element to indicate that the at least one microphone is working.

In example embodiments, the processor is further configured to determine, at least partially, via machine learning, whether the captured sound data corresponds to one of the plurality of alert sound data.

In example embodiments, the processor is further configured to determine whether the captured sound data exhibits a first characteristic of the first alert sound, the first characteristic comprises an audio signal amplitude over a first threshold and in response to determining that the captured sound data exhibits the first characteristic, send to the output device instructions to perform the output alert profile. The output device may be configured to perform the output alert profile upon receiving the instructions.

In example embodiments, the processor is further configured to determine whether the captured sound data exhibits a first characteristic of the first alert sound, the first characteristic being an audio signal frequency within a first frequency range and in response to determining that the captured sound data exhibits the first characteristic, sending to the output device instructions to perform the output alert profile. The output device can be configured to perform the output alert profile upon receiving the instructions.

In example embodiments, the at least one microphones are capable of being configured to a long range mode and a short range mode.

In example embodiments, the at least one microphones are capable of being attached proximate to the captured sound source via attachment means.

In example embodiments, the output device is a user device and the output alert profile is a sequence of vibrations.

In example embodiments, the output device is a user device and the output alert profile is a sequence of lights flashing on a screen of the user device.

In example embodiments, the output device is a user device and the output alert profile is a text message flashing on a screen of the user device.

In example embodiments, the output device, the at least one microphone and the processor are connected via a local wireless network.

In example embodiments, determining whether the captured sound data corresponds to the first alert sound of the plurality of alert sound data occurs at a scheduled interval.

According to a second aspect, an alert system comprises at least one microphone, an output device, and a processor in communication with the at least one microphone via a micro-phone communication link and with the output device via an output device communication link. The processor is configured to determine, based on machine learning or deep learning, a plurality of categories of sounds that are based on a plurality of alert sound data, and then determine a category output alert profile for each of the plurality of categories of sounds. The processor may receive over the microphone communication link captured sound data based on a sound captured by the at least one microphone and determine whether the captured sound data corresponds to a first alert sound of the plurality of alert sound data. In response to determining that the captured sound data corresponds to the first alert sound, determine an output alert profile for the first alert sound, the processor may send, to the output device, instructions to perform the output alert profile, and the output device may be configured to perform the output alert profile upon receiving the instructions. In response to determining that the captured sound data corresponds to the plurality of categories of sounds, determine a category output alert profile for corresponding plurality of categories of sounds, the processor may send, to the output device, instructions to perform the category output alert profile and the output device may be configured to perform the category output alert pro-file upon receiving the instructions.

In example embodiments, the plurality of categories of sounds comprises machine emitted sounds. In example embodiments, the plurality of categories of sounds comprises home fixture emitted sounds. In example embodiments, the plurality of categories of sounds comprises human emitted sounds. In example embodiments, the plurality of categories of sounds comprises animal emitted sounds. In example embodiments, the plurality of categories of sounds comprises non-alarm sounds.

According to a third aspect, a method of utilizing the alert systems described above comprises determining a possible alert sound source which generates the captured sound data, and determining an optimal attachment surface for the at least one micro-phone to capture sound from the alert sound source. The method includes placing the at least one microphones in close proximity to the optimal attachment surface via the attachment means.

DETAILED DESCRIPTION OF EXAMPLE EMBODIMENTS

Figure 1:
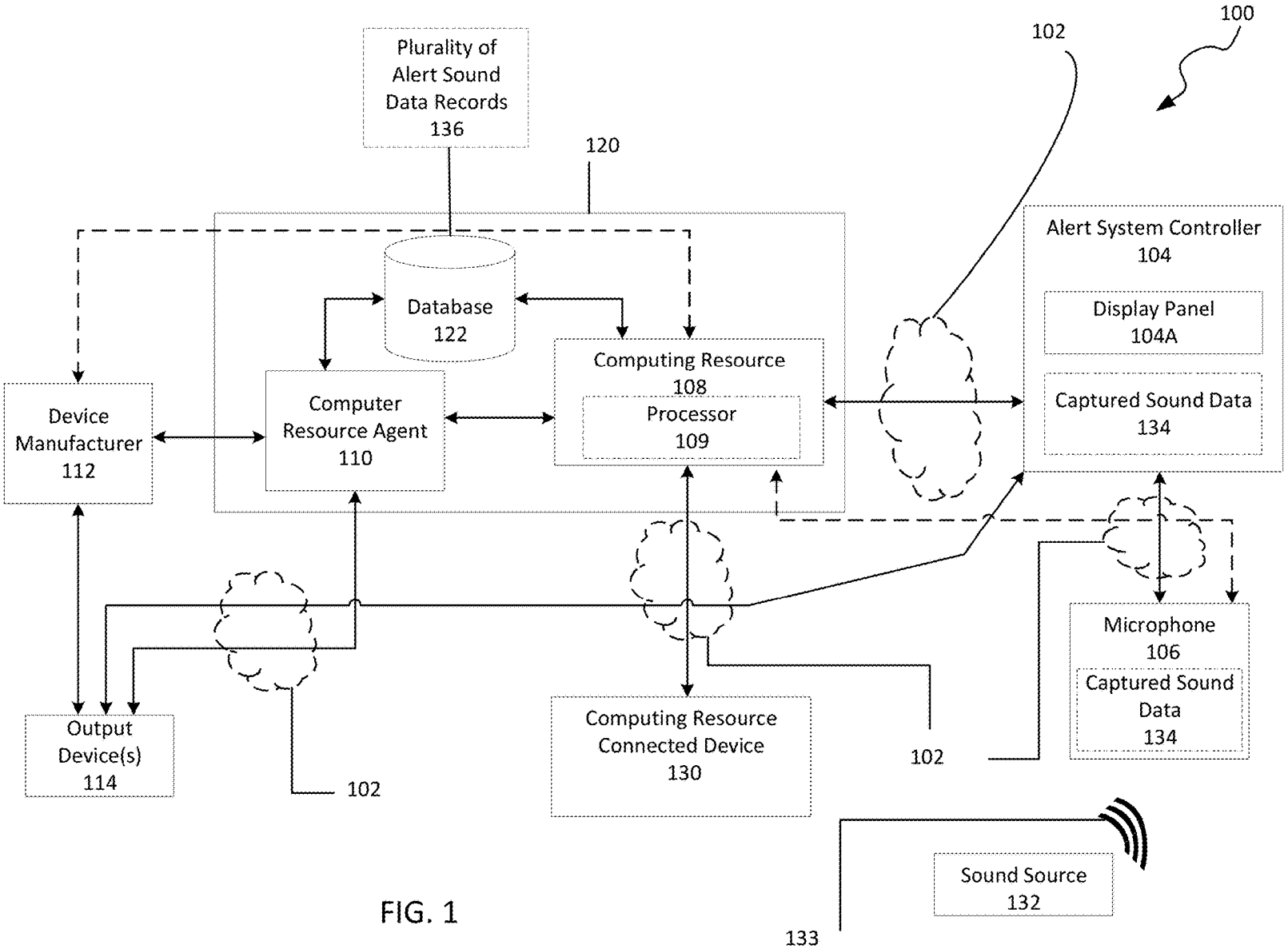
FIG. 1 is a simplified block diagram of an alert system in accordance with an example embodiment of the present disclosure.

The present disclosure is made with reference to the accompanying drawings, in which embodiments are shown. However, many different embodiments may be used, and thus the description should not be construed as limited to the embodiments set forth herein. Rather, these embodiments are provided so that this disclosure will be thorough and complete. Wherever possible, the same reference numbers are used in the drawings and the following description to refer to the same elements, and prime notation is used to indicate similar elements, operations or steps in alternative embodiments. Separate boxes or illustrated separation of functional elements of illustrated systems and devices does not necessarily require physical separation of such functions, as communication between such elements may occur by way of messaging, function calls, shared memory space, and so on, without any such physical separation. As such, functions need not be implemented in physically or logically separated platforms, although they are illustrated separately for ease of explanation herein. Different devices may have different designs, such that although some devices implement some functions in fixed function hardware, other devices may implement such functions in a programmable processor with code obtained from a machine-readable medium. Lastly, elements referred to in the singular may be plural and vice versa, except wherein indicated otherwise either explicitly or inherently by context.

Alert System

FIG. 1 shows an example embodiment of an alert system 100 according to example embodiments. In example embodiments, the alert system supports a single user that is desirous of having captured auditory alerts communicated via an output device that is not auditory. In some example embodiment, the alert system 100 can be configured to support customization for a plurality of users. The alert system 100, in example embodiments, includes a plurality (N) of microphones 106(1), 106(2) . . . 106(N) (referred to generically or collectively as at least one microphone 106) connected to a communication link 102 (also referred to as the microphone communication link). In some example embodiments, the at least one microphone 106 is an I2S MEMS microphone, or a computing resource connected device 130, such as an Amazon™ Echo. The at least one microphone 106 may be connected to a standalone alert system controller 104 via the communication link 102, or the at least one microphone 106 may be connected directly to a computing resource 108 to effect control of the alert system 100 via the communication link 102, as shown in FIG. 1 via a dotted arrow.

The at least one microphone 106 is configured to capture sound 133 from a sound source 132 and store the recording as captured sound data 134. The captured sound data 134 may include sound data from a desired source, such as an oven, fire alarm, etc., and unwanted sound data which the alarm system 100 does not act on, such as the sound of a vacuum operating. In example embodiments, the captured sound data 134 may include distorted source sounds, either because the microphone 106 is partially covered, or because a sound source 132 is covered. For example, a carbon monoxide detector may be covered with furniture. A sound source 132 can be a security alarm, a fire alarm, a doorbell, a telephone ring, and so forth.

The at least one microphone 106 may be configured to sample, or capture sound data, at varying rates with varying bit depths. For example the microphone 106 may be configured to sample sound at a rate of 8 kilohertz, and have 16 bits per sample.

In an example embodiments, the at least one microphone 106 is configured to store a fixed amount of samples, generically referred to as the singular captured sound data 134, as a buffer, prior to sending the captured sound data 134 via a communication link 102. In example embodiments, the at least one microphone 106 is configured to determine whether to send data at irregular intervals, and a sent rate may be determined based on metrics other than memory storage. For example, the rate may be increase when the network connection is considered poor. In example embodiments, a buffer of 800 samples is used. Where a buffered captured sound data 134 is incapable of being sent via a communication link 102, the buffered captured sound data 134 may be sent at the next available opportunity through the communication link 102.

In example embodiments, the captured sound data 134 is stored as a digital signal. The captured sound data 134 could be stored as an analog signal.

Figure 2:
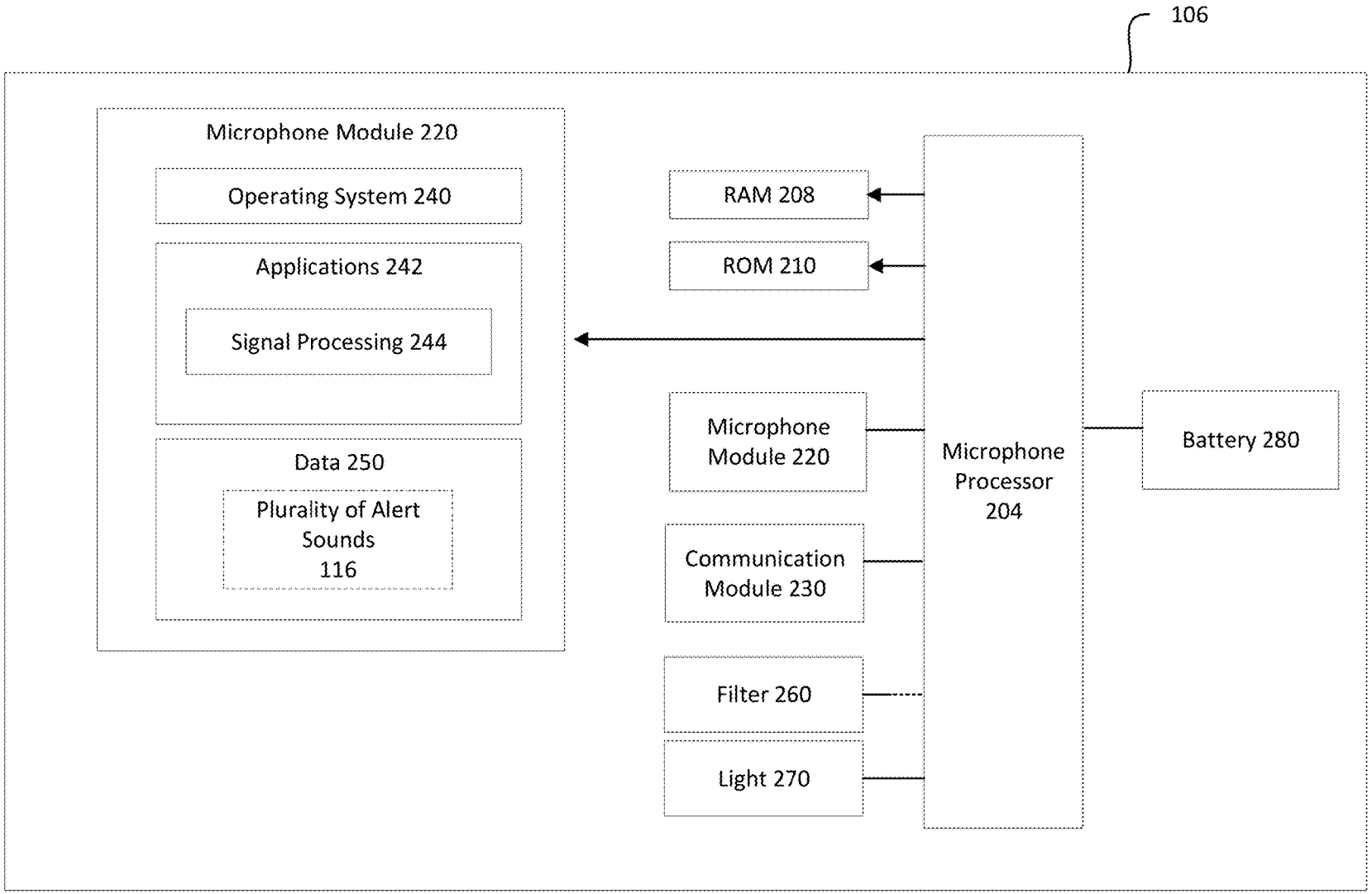
FIG. 2 is a simplified diagram of an example microphone configuration in accordance with an example embodiment of the present disclosure.
Figure 3:
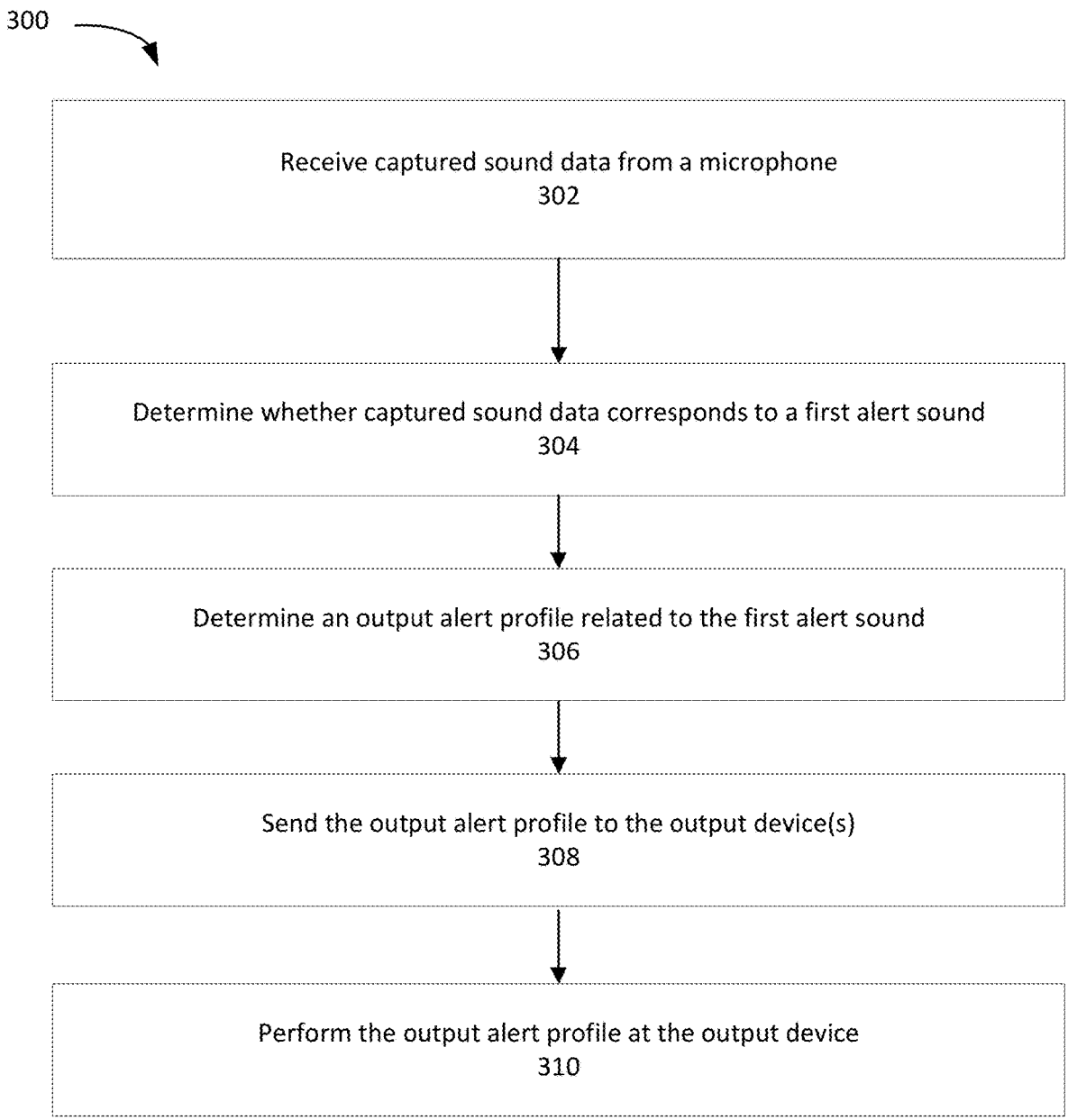
FIG. 3 is a flowchart illustrating the configuration of an alert system processor in accordance with an example embodiment of the present disclosure.
Figure 4:
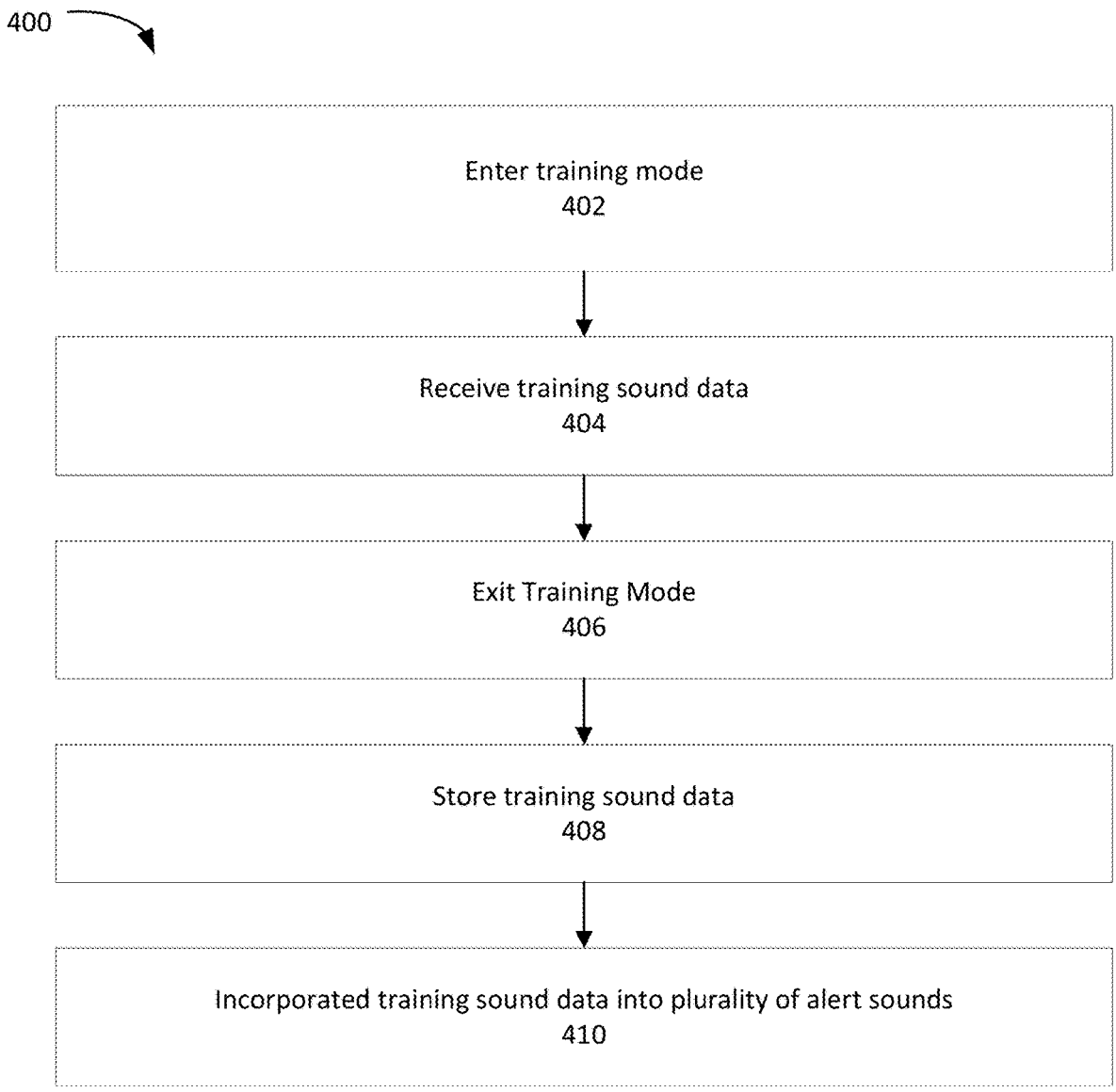
FIG. 4 is a flowchart illustrating the configuration of an alert system processor for a training mode in accordance with an example embodiment of the present disclosure.

The sample rate and the storage of the captured sound data 134 can be controlled by a microphone processor. In this regard, FIG. 2 shows an example embodiment of at least one microphone 106 of the present disclosure. In example embodiments, the at least one microphone 106 comprises at least one microphone processor 204 which controls the operation of the at least one microphone 106. The microphone processor 204 may be coupled to a plurality of components via a communication bus (not shown) which provides a communication path between the components and the microphone processor 204. The at least one microphone 106 may also comprise of a Random Access Memory (RAM) 208, Read Only Memory (ROM) 210, a persistent (non-volatile) memory 212 which may be flash erasable programmable read only memory (EPROM) ("flash memory") or other suitable form of memory, communication module 230, battery 280, light 270 and, in example embodiments, a filter 260.

Microphone 106 is capable of operating in a long range mode and a short range mode. When set to a long range mode operation, microphone 106 may be configured to receive sounds that are not close to the microphone 106, thereby avoiding noise close to the physical location of the microphone 106. In example embodiments, the microphone 106 is configured to operate in a short range mode, such that it has a heightened sensitivity to sounds near the microphone 106.

In example embodiments, the microphone 106 can be controlled by a processor not local to the microphone 106 itself. Referring to FIG. 1, the microphone 106 may be connected via the communication link 102 to a computing resource 108 having a processor 109 to operate the microphone 106. In example embodiments, not shown, the microphone 106 may be connected to the computing resource via one or more intermediary devices. A computing resource provider 120 may be configured such that access to computing resource 108, owned by computing resource provider 120, is only available through a computing resource agent 110. In these embodiments, the microphone 106 may be configured to connect directly to the computer resource agent 110.

In example embodiments, the computer resource provider 120 may have a pre-existing protocol established which utilizes the computing resource 118, allowing for easier integration with the computing resource provider 120 and outside devices. The microphone 106, for example, may be connected to the computing resource 108 utilizing the mqtt protocol over the communication link 102. In example embodiments, a computing resource agent 110 may require or provide specific application programming interfaces (APIs) in order to access the computing resource 108. The computing resource provider 120 may charge different rates for direct control of computing resource 118 or control via a computer resource agent 110, and the alert system may be configured to select the cheaper computing resource 108 access. For example, the alert system 100 may utilize Amazon Inc. as a computing resource provider 120, and be configured to control a server (computing resource 108) or access the smart home skills routine located on the Amazon Inc. Lambda Service™, which may have lower fees.

The microphone 106 may be controlled by an alert system controller 104, comprising a processor (not shown) (the processor 109 and/or the alert system controller 104 processer shall be generically referred to as "the processor"). Similar to the computing resource agent 110, the alert system controller 104 may be connected to the microphone 106 via the communication link, and have a pre-existing protocol allowing access to the processor.

An alert system controller 104 may be a portable user device, or a fixed controller. For example, an alert system controller 104 can be a phone, personal computer, raspberry pi, and so forth. The alert system controller can have an interactive display 104A, which provides a user the means to adjust settings for the alert system 100, such as saving, editing settings, entering and exiting modes, and so forth.

In example embodiments, the alert system controller 104 controls the microphone 106, and further relays captured sound data 134 to the computing resource provider 120 for analysis based on the database 122. In example embodiments, the alert controller 104 stores a copy of the captured sound data 134 locally, as shown, in addition to sending the captured sound data 134 to the computing resource provider 120.

In this regard, the computing resource provider 120 may comprise a database 122, in communication with the other elements within a computer resource provider 120. The database 122 may include the following types of data: (1) captured sound data 134 (as described above) (2) training sound data, (3) a plurality of alert sound data records 136 (also referred to as the plurality of alert sound data), (4) output alert profiles, (5) instructions and/or protocol required to connect to and/or control an output device or computing resource provider (for example, instructions allowing the computing resource 108 to use API's to connect to a specific manufacturers lightbulb) and (5) instructions to perform any one of the methods of operating an alert system as set out below.

The plurality of alert sound data 136 stored on database 122 include sound data relating to sounds that could be received at the at least one microphones 106 for which a user would like an output from the alert system 100. The plurality of alert sound data 136 may be generated by the alert system 100 through the use of a training mode (as described below). In example embodiments, the plurality of alert sound data 136 is provided by a third party.

The plurality of alert sound data 136 could be provided to the database 122 by a device manufacturer 112, wherein the device manufacturer provides an alert sound for a specific or series of devices that it produces. For example, an oven manufacturer could provide the alert sound data corresponding to each oven model produced. As an example, GE could provide that a beep, followed another beep 5 seconds later represents a safety alert in regards to a particular oven.

In example embodiments, the plurality of alert sound data 136 stored in database 122 may comprise information related to the meaning of the alert sound, referred to as a label. The information related to the meaning of the sound may include an urgency level, a description of the alert, and/or instructions for resolving the alert. For example, a label may be attached to the GE alert sound described above, indicating that the alert sound represents that an oven timer has expired.

The alert output profiles stored by database 122 includes information related to, once the captured sound data 134 is identified as corresponding to an alert sound, how to convey this alert to a user via an output device 112. In example embodiments, the alert output profiles are provided by the device manufacturer 112 depending on output device 112 capability. In example embodiments, the alert output profiles are configured by the user. Where a user has access to more than one output device 114, the processor may allow the user to combine output functionality of multiple output devices 114 as part of an output alert profile. For example, a user may be able to set an alert profile consisting of a flickering light and a sequence of vibrations of an output device.

Output device 114 can be any device capable of generating a physical alert that does not require sound and capable of being in communication with the processor. An output device 114 can be a conventional alert device, such as a light, which has been manufactured to be able to connect to communication link 102 (referred to as the output device communication link). An output device may be a device that does not have an output itself, but is configured to control another output device indirectly. For example, a switch which controls certain power outlets that have a light connected to them may be an output device. In example embodiments, an output device is a personal computing device, which can include wearable personal devices such as watches, exercise aids (i.e. Fitbits™), wearable computing devices (i.e. Apple™ Watch) and non-wearable computing devices such as phones, tablets, etc. Output devices may have multiple means of alerting a user, such as a sequence of vibrations, emitting light generally, and displaying information.

In example embodiments, the information related to the meaning of the sound, described above, can be provided to the user when the alert output profiles are being configured.

Training sound data is captured sound data 134 from the alert system 100 when it is a training mode (as described below), and may include a user defined related output alert profile. The training sound data can be of varying qualities, and can include sound profiles that are specifically determined not to be alerts. For example, a dog's bark may be recorded as training sound data in order to configure the alert system 100 not to generate an output. In example embodiments, the database 122 separately stores alert sounds captured by the at least one microphone 106 while it was in a training mode, and the alert sounds provided by a device manufacturer 112.

The device manufacturer 112 may also provide the instructions/protocol required to connect to and control an output device manufactured by the device manufacturer 112. For example, one device made by a device manufacturer 112 may communicate via a Zigbee® protocol, while a separate device made by the device manufacturer 112 may operate using the Z-Wave protocol.

The processor, utilizing the data stored in database 112, is configured to determine whether the captured sound data 134 corresponds to a first alert sound of the plurality of alert sound data 136. In example embodiments, determining whether the captured sound data 134 corresponds to a first alert sound may include determining whether a portion of the captured sound data 134 corresponds to a portion of the first alert sound data. Determining whether the captured sound data 134 corresponds to a first alert sound may include processing the captured sound data 134 and first alert sound data into abstract n dimensional vectors, and comparing a similarity between two vectors. Corresponding may be assessed on whether the captured wavelength, amplitude, cycle, frequency, etc., coincide over a selected period of time.

In example embodiments, determining whether the captured sound data 134 corresponds to a first alert sound may include filtering the sound to reduce noise. In example embodiments, the filtering may comprise increasing the amplitude of certain frequencies of the captured sound data 134. Filtering may comprise altering the captured sound data 134 through removing captured sound data 134 which has an amplitude below a certain level. In example embodiments, filtering may include removing already known noise sounds. For example, the database 122 may store sounds which should be determined to not correspond to a first alert sound of the plurality of alert sound data 136.

In example embodiments, determining whether the captured sound data 134 corresponds to a first alert sound may include identifying characteristics in the captured sound data 134. For example, the captured sound data 134 may include short loud noises occurring at regular intervals (a characteristic), which may be similar to the short loud noises and intervals of the first alert sound, but at a different frequency. The processor may determine that the two sounds correspond to one another.

In example embodiments, determining whether the captured sound data 134 corresponds to a first alert sound, or any of the plurality of alert sound data 136, at least in part may include utilizing machine learning techniques. For example, the stored plurality of alert sound data 136, and the training sound data, may be used as training data to teach a neural network. The neural network may determine degrees of similarity between the training data and the captured sound data 134. The neural network may determine categorizations of the alert sounds based on the training data, which may include an unknown sound category, and correlate the captured sound data 134 with a category.

In example embodiments, determining whether the captured sound data 134 corresponds to a first alert sound may comprise determining that the captured sound data 134 has a characteristic over a threshold. For example, a characteristic may be an audio signal amplitude over the threshold, an audio signal frequency within a frequency threshold, and so forth. The threshold may, for example, be set so that captured sound data 134 which is loud enough triggers an alarm.

Machine learning/deep learning can be utilized to filter the captured sound data 134. Machine learning can be used where features are defined, and deep learning can be used where features are undefined.

In example embodiments, deep learning is used to, at least in part, determine a plurality of categories of sounds in order to assist in captured sound identification. The processor can determine categories by ingesting existing plurality of alert sound data (for example available sounds on YouTube), and determining groupings between the sounds. The processor, in example embodiments, can be solely responsible for determining the plurality of categories of sounds and may do so without the use of labelled data, or a user may specify parameters or constraints that limits the processors ability to determine categories outside the said parameters.

Machine learning can comprise ingesting data pursuant to defined features, allowing the processor to better categorize sounds relative to the defined features. Machine learning can comprise any one of or any combination of (1) Spectrogram (Fast Fourier Transform (FFT) over the small window) and utilizing the hash function on the amplitudes of the spectrogram as audio fingerprints and performing Time-Frequency Amplitude analysis, (2) Tonal Centroid algorithms, (3) Log Mel-Spectrogram, (4) Chroma Energy Normalized, (5) Mel-Frequency Cepstral Coefficients, (6) Spectral Centroid, (7) Root Mean Square (RMS), and (8) Local autocorrelation. The machine learning can be implemented via pythonAudioAnalysis.

The plurality of categories of sounds, in example embodiments, can include the following: (1) machine emitted sounds (this can include all beeping sounds, and can allow a user to rule out the other categories given the distinctness of the sounds), (2) human emitted sounds, (3) animal emitted sounds (to tell a user whether a dog, for example, is alerting to an issue or has to use the bathroom), (4) non-alarm sounds (which are used by the processor to refrain from sending instructions to have an output alert profile performed), and (5) home fixture emitted sounds, which may be indicative of issues around the house, for example the sound of water continuously running from the sink.

In example embodiments, the processor determines the plurality of categories of sounds and uses them at least in part to determine determining whether the captured sound data 134 corresponds to a first alert sound by determining whether the first alert sound and the captures sound correspond to the same or different categories of sounds.

The processor, once the categories of sounds are determined, can determine a category output alert profile for each of the plurality of categories of sounds. For example, sounds that are categorized as distant may have an output alert profile that conveys that the sound is distant through the use of echo.

In the example embodiments described above in relation to corresponding the captured sound data 134 and the first alert sound, corresponding may include determining whether a threshold has been reached. In example embodiments, a threshold could include a similarity threshold, wherein if the captured sound data 134 and first alert sound only have a similarity below a certain similarly threshold, they will not be considered to correspond.

Once captured sound data 134 is determined to correspond to the first alert profile, the processor determines an output alert profile related to the first alert sound. The output alert profile related to the first alert sound may be configured by the user through the alert system controller 104, or the user may access the computing resource 108 processor via the computer resource agent and adjust the relationship between the plurality of alert sound data 136 and the plurality of output alert profiles. For example, a user may be able to view and reconfigure the output alert profile for a fire alarm going off on a mobile device.

Once the output alert profile related to the first alert sound is determined by the processor, it is send to the output device 114 (via output device communication links). In example embodiments, the instructions of the first alert profile are sent to and require multiple output devices 114. The processor, based on data stored in database 112, is capable of sending the instructions to multiple device profiles which use various communication links 112, protocols, APIs, etc. In example embodiments, the output alert profile is sent to the output devices in multiple batches, or the output alert profiles are sent as a whole. In example embodiments, all output alert profiles are stored on the output device 114, and the processor sends the corresponding activation sequence for the output alert profile which corresponds to the first alert sound. In example embodiments, the output device is a light emitter, and the output alert profile consists of a flickering sequence.

In example embodiments, where communication link 102 comprises multiple technologies, the alert system controller 104 and/or the computing resource provider 120 may be configured to send the determined output alert profile to the output device 114 via a variety of communication link 102 technologies. For example, the alert system controller 104 may send the output alert profile to the output device via Wi-Fi, Bluetooth, and so forth. In example embodiments, the at least one microphone 106 and the processor are connected via a local wireless network. The alert system controller 104 may be configured to use progressively more communication technologies depending on the severity of the alert, in order to insure that a message reaches a user via an output device.

The output device 114 is configured to perform the output alert profile upon receiving same from the processor. Alert system 100 may be configured to have an output alert profile performed by an output device 114 even where the output device is a portable device and the user may not be at home. For example, alert system 100, after determining, via an alert system controller 104, that a fire alarm sound has been sensed by the microphone 106, may have a phone app provide a notification or vibration to a user. In example embodiments, output device 114 displays a text message on its screen. The output alert profile may a sequence of lights flashing on the screen of the output device 114.

In example embodiments, the communication link 102 may comprise multiple technologies, wired or wireless, allowing the microphone 106 to send the captured sound data 134 to the alert system controller 104 and/or the computing resource provider 120, or as described above allowing alert system controller 104 and/or the computing resource provider 120 to send the output alert profiles to the output devices 114. For example, referring again to FIG. 2, the communication module 230 which utilizes the communication link 102, may comprise any combination of a long-range wireless communication module, and a short-range wireless communication module. The long-range wireless communication module may comprise a wireless local area network (WLAN) transceiver for communicating with a WLAN via a WLAN access point (AP). The WLAN may comprise a Wi-Fi wireless network which conforms to IEEE 802.11x standards (sometimes referred to as Wi-Fi®) or other communication protocol. The short-range communication module may comprise devices, associated circuits and components for providing various types of short-range wireless communication such as Bluetooth™, RFID (radio frequency identification), near field communication (NFC), IEEE 802.15.3a (also referred to as UltraWideband (UWB)), Z-Wave, ZigBee, ANT/ANT+ or infrared (e.g., Infrared Data Association (IrDA) communication).

In example embodiments, the alert system 100 features a training mode which can be activated by a user. Processor configuration 400 may be used to operate the training mode.

At step 402, the alert system 100 is entered into a training mode. The alert system 100 may enter a training mode through the use of a physical button located on the microphone 106, or via a user input from an alert system controller 104.

At step 404, the processor receives training sound data from the microphone 106.

At step 406, the alert system 100 exits the training mode. The user may activate the exiting of training mode via a physical button or a command from the alert system controller 104. For example, an alert system 100 app on a phone may allow a user to exit the training mode. In some embodiments, for example, the training mode may be exited based on a passage of time past a threshold.

At step 410, the processor stores the captured training sound data in the database 122, or the microphone 106 memory.

Once the training sound data is stored, the user may be able to view, or replay the captured sound. In example embodiments, the user is able to do so via the display panel 104A of the alert system controller 104. The alert system controller 104 may be configured to notify a user that a training sound has been captured and that it does not have a label or a corresponding output alert profile. In example embodiments, the user is able to add metadata, relationships between the training sound data and output alert profile, or labels to the captured training sound data.

At step 410, once the training sound data is stored, it is incorporated into the plurality of alert sound data 136 in database 122. In example embodiments, the training sound data is only stored once the user confirms that the training sound data is correctly captured. In example embodiments, the training sound data is incorporated after a default period of time without user interaction.

Referring now to FIG. 2, microphone processor 204 may be configured to store captured sound data 134 and filter the stored data prior to sending the captured sound data 134 to the processor.

In example embodiments, the processor 204, via a signal processing application 244, is configured to determine whether the captured sound data 134 exhibits a first characteristic of the first alert sound. Similar to determining whether a captured data sound corresponds to a first alert sound, determining whether the captured sound data 134 exhibits a first characteristic involves determining characteristics of the first alert sound and the captured sound data 134. A characteristic can be, for example, a general pattern within the sound data such as a beat or interval between sounds. In example embodiments, determining whether the captured sound data 134 exhibits the first characteristic is based on portions of the captured data and the first alert sound.

In example embodiments, captured sound data 134 may be provided to the filter 260 prior to the microphone processor 204 in order to determine whether a captured sound data 134 should be sent to the processor. For example, the microphone processor 204 may be configured to, upon receiving from the filter 260 captured sound data 134 that was processed by the filter 260 as exhibiting a first characteristic, sending the captured sound data 134 to the processor. The first characteristic may be an audio signal amplitude over a first threshold, an audio signal frequency within a first frequency range, and so forth. The first threshold may, for example, be set so that captured sound data 134 which are inaudible to the human ear would not be sent to the processor. The first frequency range may, for example, be configured to not send captured sound data 134 which are inaudible to the human ear to the processor.

The filter 260 may be analog, in order to minimize computing power required. In example embodiments, the functions of the filter 260 are performed by the signal processing application 244, and no filter 260 is included in the microphone 106.

In example embodiments the processor may be entered into a sleep mode until captured sound data 134 is sent by the microphone processor 204. The microphone processor 204 may be configured to receive captured sound data 134 filtered by the filter 260 to determine whether the captured sound data 134 should be sent to the processor. Where captured sound data 134 that was processed by the filter 260 as exhibiting a first characteristic, the microphone processor 204 may send the captured sound data 134 to the processor. The processor may wake up upon receiving captured sound data 134 over the communication link 102 from the microphone processor 204. In example embodiments, upon the processor determining whether or not the sent captured sound data 134 corresponds to a first alert sound (and sending instructions as described herein where required), the processor may return to a sleep mode. In example embodiments, the captured sound data 134 may be further processed by a signal processing application 244. In example embodiments, the microphone processor 204 may be configured to enter into a sleep mode upon sending the captured sound data 134 to the processor.

In example embodiments, the microphone processor 204 is configured to sample at a lower rate, and does not send any data until it is determined whether the captured sound data 134 should be sent to the processor. In example embodiments, an additional microphone (not shown) is added to the system, which is used to wake-up the original microphone. In some embodiments, for example, the additional microphone (not shown) is capable of waking up or sending captured data to the processor.

In summary, as discussed above, the trigger in determining whether captured sound data 134 should be sent to the processor, whether via microphone processor 204 or the additional processor can include an amplitude threshold, frequency range, an amplitude threshold for a defined duration (i.e. if the next 5 samples are above the threshold), and envelope matching, which can include comparing the captured sound data with a general envelope (shape of the data) that can separate sound vs noise characteristics.

In the example of envelope matching, in example embodiments, if the envelopes match for a given window of data with a stored template and if the match was above a percentage, the captured sound data 134 may be considered as requiring a wakeup of the processor or microphone processor 204 or the system for full functionality.

In the scenario of an amplitude threshold for a defined duration, in example embodiments if at only one sample the microphone processor 204 (or additional microphone) observes a value above the threshold and then next samples data goes back to zero, the microphone processor 204 may be configured to wake up the processor.

In response to determining that the captured sound data 134 does exhibit a first characteristic, the microphone processor 204 can be configured to send the captured sound data 134 to the processor. In example embodiments, where the captured sound data 134 does not exhibit a first characteristic, the microphone processor 204 may be configured to activate light 270 to visually display a non-alert sound. For example, if a user wants to determine whether the alert system 100 perceives a sound as an alert sound (i.e. for maintenance or diagnostic reasons), the light 270 may flash red where no alert sound is triggered. In example embodiments, the non-alert sound light 270 may be triggered only upon entering into a diagnostic mode.

Figure 5:
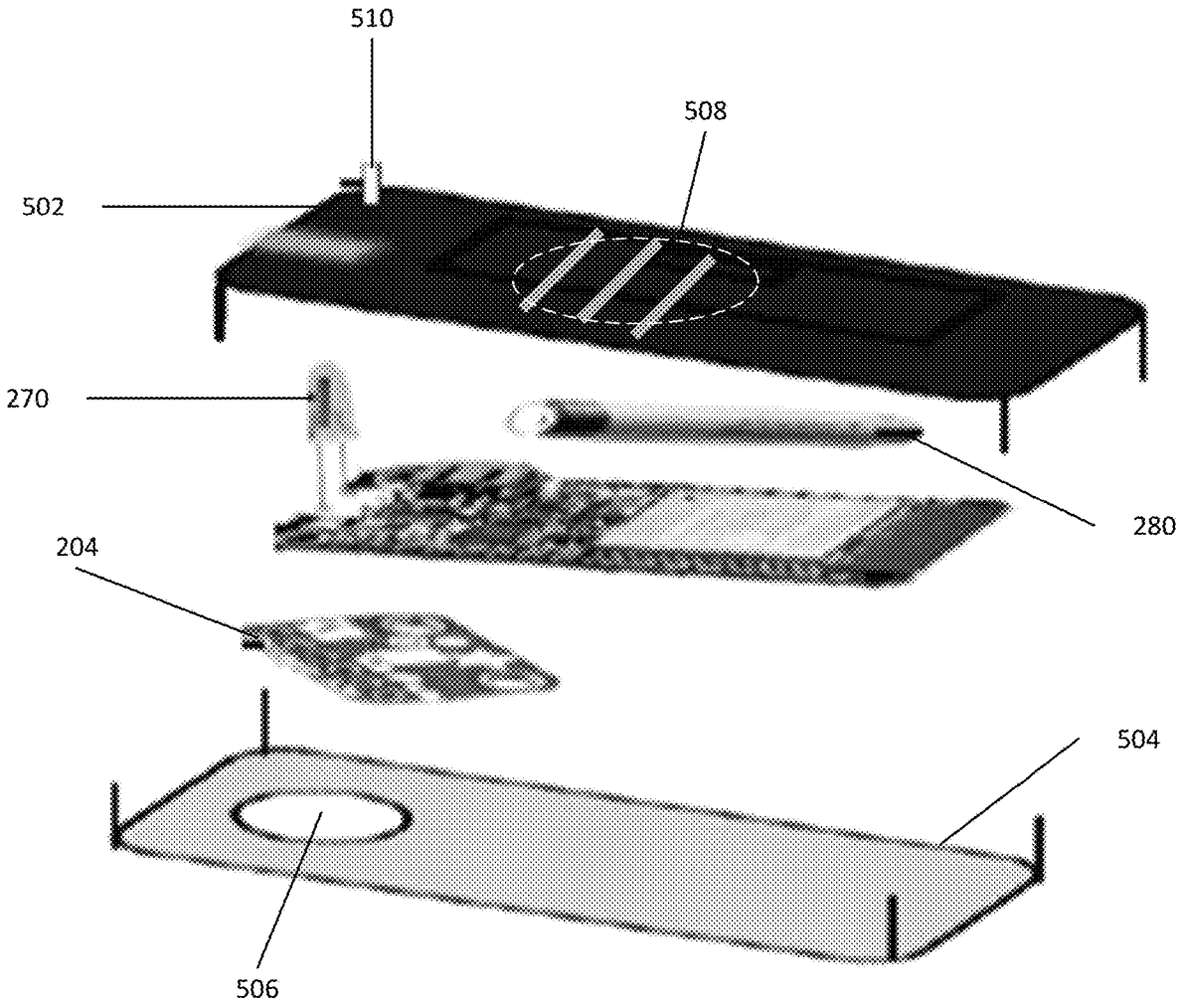
FIG. 5 is a perspective exploded view of a microphone in accordance with an example embodiment of the present disclosure.

Referring now to FIG. 5, an example microphone 106 structure according to example embodiments is shown. Microphone 106 may comprise of a first cover 502 and a second cover 504. The first cover 502 and second cover 504 can house the battery 280, the light 270, and the processor 204. In example embodiments, the light 270 is located on microphone 106 such that it is visible to a user upon being connected close to a sound source 132. The first cover may contain attachment means 508.

The attachment means 508 can be a one or series of adhesive strips/areas. In example embodiments, the attachment means are a pin or Velcro™ mechanism. The attachment means 508 can be located on the first cover 502, or in example embodiments the attachment means 508 are connected to the second cover 504.

The attachment means 508 may be implemented using the following method: (1) determining a possible alert sound source 132, (2) determining an optimal attachment surface for the at least one microphone to capture sound from the alert sound source 132 (in some electronic devices, the emitted sound is highly localized; in applications where one microphone is intended to sense multiple devices, a surface equidistant from the possible alert sound source 132 may be optimal, depending on the devices line of sight, etc.); and (3) placing the at least one microphones in close proximity to the optimal attachment surface via the attachment means.

In example embodiments, the second cover 504 includes a microphone hole 506 and attachment means 508, whereby the microphone 106 is attached to a source with the attachment means 508 such that the microphone hole 506 is proximate to the sound source 132 of the emitting device. For example, the microphone hole 506 may be located, via the attachment means 508, proximate to the speaker of a fire alarm. In example embodiments, the microphone hole 506 may be located on the first cover 502, facing a general area.

The microphone 106 may comprise a means of accessing and changing the battery 280 on the first cover 502 or the second cover 504.

In example embodiments, the light 270 may be used to convey information to the user about the status of the microphone 106. For example, the light 270 may be configured to emit light of a certain color or sequence when the battery 280 of the microphone 106 is low. In example embodiments, the light 270 may be configured to emit light of a certain color or sequence when the connection strength of the communication link 102 falls below a certain level. The light 270 may simply emit a blinking green light to indicate that sound is being observed and sent.

The light 270 on a microphone may be a simple, power efficient light emitting diode (LED) light bulb capable of displaying only one color to indicate an action being undertaken. In example embodiments, the light 270 may be able to display a plurality of lights, allowing for combinations of colors to represent more complex signals.

In example embodiments, the microphone 106 may comprise a switch 510, allowing the user to turn particular microphone 106 units off while maintaining active other microphone 106 units.

The microphone 106 may locally store a plurality of alert sound data 136 or the captured sound data 134, either in the persistent memory 212, RAM 208, or ROM 210.

The communication module 230 of the at least one microphone 106 may comprise one or more antennas, a processor such as a digital signal processor (DSP), and local oscillators (LOs). The specific design and implementation of the communication module 230 is dependent upon the communication technologies implemented by the at least one microphone 106.

Operating system software 240 executed by the processor 204 is stored in the persistent memory 212 but may be stored in other types of memory devices, such as ROM 208 or similar storage element. A number of applications 242 executed by the processor 204 are also stored in the persistent memory 212. The applications 242 may include the signal processing application 244. Other applications may also be stored in the memory 126.

In example embodiments, the captured sound data 134 is a data set of a first amount of captured sampled sounds.

The steps and/or operations in the flowcharts and drawings described herein are for purposes of example only. There may be many variations to these steps and/or operations without departing from the teachings of the present disclosure. For instance, the steps may be performed in a differing order, or steps may be added, deleted, or modified.

The coding of software for carrying out the above-described methods described is within the scope of a person of ordinary skill in the art having regard to the present disclosure. Machine-readable code executable by one or more processors of one or more respective devices to perform the above-described method may be stored in a machine-readable medium such as the memory of the data manager. The terms "software" and "firmware" are interchangeable within the present disclosure and comprise any computer program stored in memory for execution by a processor, comprising Random Access Memory (RAM) memory, Read Only Memory (ROM) memory, EPROM memory, electrically EPROM (EEPROM) memory, and non-volatile RAM (NVRAM) memory. The above memory types are examples only, and are thus not limiting as to the types of memory usable for storage of a computer program.

All values and sub-ranges within disclosed ranges are also disclosed. Also, although the systems, devices and processes disclosed and shown herein may comprise a specific plurality of elements, the systems, devices and assemblies may be modified to comprise additional or fewer of such elements. Although several example embodiments are described herein, modifications, adaptations, and other implementations are possible. For example, substitutions, additions, or modifications may be made to the elements illustrated in the drawings, and the example methods described herein may be modified by substituting, reordering, or adding steps to the disclosed methods.

Features from one or more of the above-described embodiments may be selected to create alternate embodiments comprised of a subcombination of features which may not be explicitly described above. In addition, features from one or more of the above-described embodiments may be selected and combined to create alternate embodiments comprised of a combination of features which may not be explicitly described above. Features suitable for such combinations and subcombinations would be readily apparent to persons skilled in the art upon review of the present application as a whole.

In addition, numerous specific details are set forth to provide a thorough understanding of the example embodiments described herein. It will, however, be understood by those of ordinary skill in the art that the example embodiments described herein may be practiced without these specific details. Furthermore, well-known methods, procedures, and elements have not been described in detail so as not to obscure the example embodiments described herein. The subject matter described herein and in the recited claims intends to cover and embrace all suitable changes in technology.

Although the present disclosure is described at least in part in terms of methods, a person of ordinary skill in the art will understand that the present disclosure is also directed to the various elements for performing at least some of the aspects and features of the described methods, be it by way of hardware, software or a combination thereof. Accordingly, the technical solution of the present disclosure may be embodied in a non-volatile or non-transitory machine-readable medium (e.g., optical disk, flash memory, etc.) having stored thereon executable instructions tangibly stored thereon that enable a processing device to execute examples of the methods disclosed herein.

The term "processor" may comprise any programmable system comprising systems using microprocessors/controllers or nanoprocessors/controllers, digital signal processors (DSPs), application specific integrated circuits (ASICs), field-programmable gate arrays (FPGAs) reduced instruction set circuits (RISCs), logic circuits, and any other circuit or processor capable of executing the functions described herein. The term "database" may refer to either a body of data, a relational database management system (RDBMS), or to both. As used herein, a database may comprise any collection of data comprising hierarchical databases, relational databases, flat file databases, object-relational databases, object oriented databases, and any other structured collection of records or data that is stored in a computer system. The above examples are example only, and thus are not intended to limit in any way the definition and/or meaning of the terms "processor" or "database".

The present disclosure may be embodied in other specific forms without departing from the subject matter of the claims. The described example embodiments are to be considered in all respects as being only illustrative and not restrictive. The present disclosure intends to cover and embrace all suitable changes in technology. The scope of the present disclosure is, therefore, described by the appended claims rather than by the foregoing description. The scope of the claims should not be limited by the embodiments set forth in the examples, but should be given the broadest interpretation consistent with the description as a whole.

The invention claimed is:

1. An alert system comprising:

at least one microphone configured to capture a sound;

an output device;

a processor, in communication with the at least one microphone via a microphone communication link and with the output device via an output device communication link, configured to:

receive over the microphone communication link captured sound data based on the sound captured by the at least one microphone;

determine whether the captured sound data corresponds to a first alert sound of a plurality of alert sounds; and in response to determining that the captured sound data corresponds to the first alert sound, determine an output alert profile for the first alert sound;

send, to the output device, instructions to perform the output alert profile;

the output device being configured to perform the output alert profile upon receiving the instructions;

the microphone comprising a microphone processor configured to:

determine whether the captured sound data exhibits a first characteristic of a first alert sound; and in response to determining that the captured sound data exhibits the first characteristic, send the captured sound data to the processor.

2. The system of claim 1, wherein the at least one microphone further comprises attachment means for attaching the at least one microphone to a surface or object close to a captured sound source.

3. The system of claim 1, wherein the microphone processor is further configured to:

enter into a sleep mode; and in response to the step of receiving captured sound data over the microphone communication link, exit the sleep mode.

4. The system of claim 1, wherein the first characteristic comprises an audio signal amplitude over a first threshold.

5. The system of claim 1, wherein the first characteristic comprises an audio signal frequency within a first frequency range.

6. The system of claim 1, wherein the processor is located on a remote server or cloud based computing system, and the microphone communication link and output communication link each comprise a network communication link.

7. The system of claim 1, wherein the processor is further configured to:

receive trained sound data and a customized alert profile related to the trained sound data;

store the trained sound data as corresponding to one of the plurality of alert sounds; and in response to receiving the captured sound data from the at least one microphone, the processor being further configured to:

determine whether the sound is the trained sound;

in response to determining that the captured sound data is the trained sound data, determine that the captured sound data corresponds to one of the plurality of alert sounds; and send, to the output device, instructions to perform the output alert profile.

8. The system of claim 1, wherein the processor is further configured to:

enter into a training mode;

receive a training sound data from the at least one microphone;

store the training sound data as corresponding to one of the plurality of alert sounds; and exit the training mode; and in response to receiving the captured sound data from the at least one microphone, the processor being further configured to:

determine whether the captured sound data corresponds to the training sound data; and in response to determining that the captured sound data corresponds to the training sound data, determine that the captured sound corresponds to one of the plurality of alert sounds.

9. The system of claim 8, wherein the processor is further configured to:

display, on a user device, receipt of the training sound data;

receive, via the user device, a training sound label and training sound alert profile;

store the training sound data, the training sound label and the related training sound alert profile; and in response to determining that the captured sound data corresponds to the training sound data, send to the output device instructions to perform the training sound alert profile.

10. The system of claim 1, wherein the at least one microphone includes a visual element to indicate that the at least one microphone is working.

11. The system of claim 1, wherein the processor is further configured to determine, at least partially, via machine learning, whether the captured sound data corresponds to one of the plurality of alert sounds.

12. The system of claim 1, wherein the processor is further configured to:

determine whether the captured sound data exhibits a first characteristic of the first alert sound, the first characteristic comprising an audio signal amplitude over a first threshold; and in response to determining that the captured sound data exhibits the first characteristic, sending to the output device instructions to perform the output alert profile;

the output device being configured to perform the output alert profile upon receiving the instructions.

13. The system of claim 1, wherein the processor is further configured to:

determine whether the captured sound data exhibits a first characteristic of the first alert sound, the first characteristic comprising an audio signal frequency within a first frequency range; and in response to determining that the captured sound data exhibits the first characteristic, sending to the output device instructions to perform the output alert profile;

the output device being configured to perform the output alert profile upon receiving the instructions.

14. The system of claim 1, wherein the at least one microphone is capable of being configured to a long range mode and a short range mode.

15. The system of claim 2, wherein the at least one microphone is capable of being attached proximate to the captured sound source via the attachment means.

16. The system of claim 1, wherein the output device, the at least one microphone and the processor are connected via a local wireless network.

17. The system of claim 1, wherein determining whether the captured sound data corresponds to the first alert sound of the plurality of alert sounds occurs at a scheduled interval.

18. An alert system comprising:

at least one microphone;

an output device;

a processor, in communication with the at least one microphone via a microphone communication link and with the output device via an output device communication link, configured to:

determine, based on machine learning or deep learning, a plurality of categories of sounds that are based on a plurality of alert sounds;

determine a category output alert profile for each of the plurality of categories of sounds;

receive over the microphone communication link captured sound data based on a sound captured by the at least one microphone;

determine whether the captured sound data corresponds to a first alert sound of the plurality of alert sounds;

in response to determining that the captured sound data corresponds to the first alert sound, determine an output alert profile for the first alert sound;

send, to the output device, instructions to perform the output alert profile;

the output device being configured to perform the output alert profile upon receiving the instructions;

in response to determining that the captured sound data corresponds to the plurality of categories of sounds, determine a category output alert profile for corresponding plurality of categories of sounds;

send, to the output device, instructions to perform the category output alert profile; and the output device being configured to perform the category output alert profile upon receiving the instructions.

19. A method of utilizing the alert system of claim 2, comprising:

determining a possible alert sound source which generates the sound;

determining an optimal attachment surface for the at least one microphone to capture the sound from the alert sound source; and placing the at least one microphone in close proximity to the optimal attachment surface via the attachment means.

20. The method of claim 19, wherein:

the at least one microphone comprises a plurality of microphones; and the method further comprises, for each respective microphone of the plurality of microphones:

determining a respective possible alert sound source which generates the respective sound;

determining a respective optimal attachment surface for the respective microphone to capture the respective sound from the respective alert sound source; and placing the respective microphone in close proximity to the respective optimal attachment surface via the respective attachment means.

* * * * *